United States Patent [19]

George

[11] 4,018,371

[45] Apr. 19, 1977

[54] BEVERAGE BELT

[76] Inventor: Stanley Ross George, 6712 Balcom Ave., Reseda, Calif. 91335

[22] Filed: July 29, 1975

[21] Appl. No.: 599,955

Related U.S. Application Data

[63] Continuation-in-part of Ser. No. 353,226, April 23, 1973, abandoned.

[52] U.S. Cl. ..... 224/26 R; 224/5 W; 220/23.2

[51] Int. Cl.[2] ..... A45C 11/00

[58] Field of Search ..... 224/5 W, 5 R, 26 R, 224/25 R, 7 R, 5 V, 5 H, 5 G, 5 A, 29 B, 13, 17, 21, 42.42 R, 42.45 R, 42.46 R; 220/9 F, 23.2

[56] References Cited

UNITED STATES PATENTS

| | | | |
|---|---|---|---|
| 1,569,157 | 1/1926 | Thompson | 224/5 R |
| 2,655,282 | 10/1953 | Dunbar | 220/23.8 X |
| 3,848,766 | 11/1974 | Ganti et al. | 220/9 F |

FOREIGN PATENTS OR APPLICATIONS

| | | | |
|---|---|---|---|
| 717,350 | 9/1965 | Canada | 224/26 R |

*Primary Examiner*—Robert J. Spar
*Assistant Examiner*—Jerold M. Forsberg
*Attorney, Agent, or Firm*—Jack C. Munro

[57] ABSTRACT

A beverage belt adapted to be worn upon a person, said belt including a housing formed of insulative material, said housing including a plurality of spaced apart beverage containing pockets, each said pocket adapted to be closed by a lid, each said lid to be securable upon its respective said pocket by means of a bayonet slot assembly, and the free ends of said belt including securing means to interconnect together the ends of said belt when placed about a person's body.

4 Claims, 7 Drawing Figures

BEVERAGE BELT

This application is a Continuation-In-Part of application Ser. No. 353,226 filed Apr. 23, 1973 now abandoned.

BACKGROUND OF THE INVENTION

It is well known to use a belt for numerous purposes. Examples of such belts are belts that include pockets to contain money, a gun cartridge belt, or a belt that functions as a life perserver when in water. However, there has been no known belt which has been designed in particular to support cold closed containers, such as a beverage can and keep these beverage containers in a refrigerated state.

SUMMARY OF THE INVENTION

The subject matter of this invention is believed to be summarily described in the Abstract of the Disclosure and reference is to be had thereto.

The primary objective of this invention is to provide a novel beverage belt adapted to receive a plurality of beverage containers, such as beverage cans and maintain the beverage containers in a refrigerated condition. A further objective of this invention is that the belt is to be constructed of an inexpensive insulative material and that the belt of this invention can be constructed most inexpensively.

DETAILED DESCRIPTION OF THE SHOWN EMBODIMENT

Figure 1:
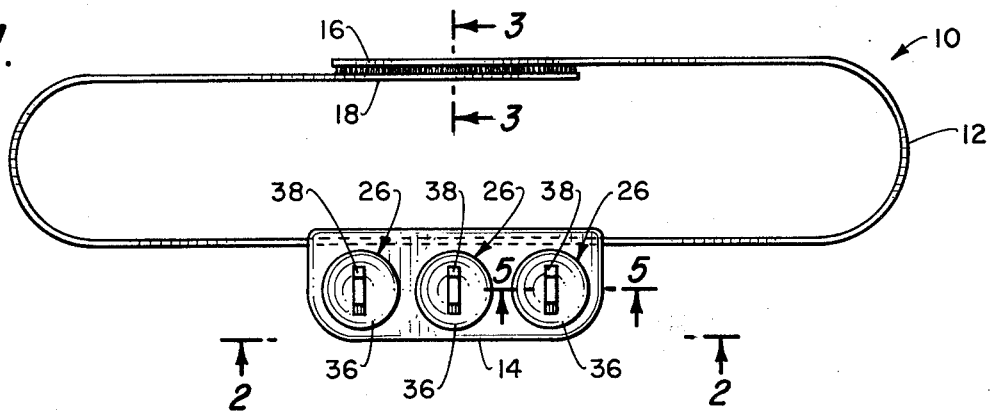
FIG. 1 is a top view of the beverage belt of this invention.
Figure 2:
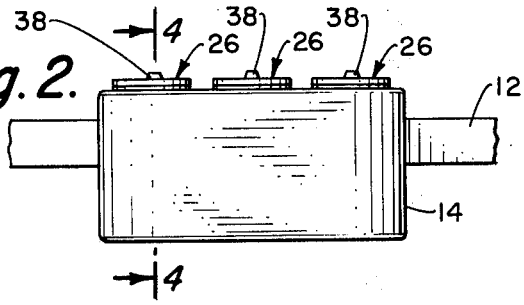
FIG. 2 is a front view of the beverage belt of this invention taken along line 2—2 of FIG. 1.
Figure 3:
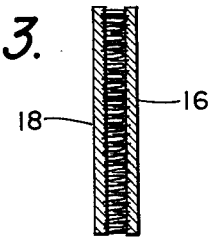
FIG. 3 is a cross-sectional view taken along line 3—3 of FIG. 1.
Figure 4:
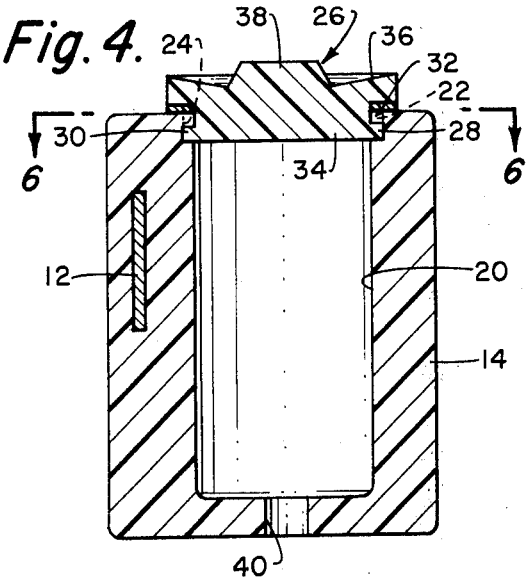
FIG. 4 is a cross-sectional view through one of the pockets formed within the beverage belt of this invention taken along line 4—4 of FIG. 2.
Figure 5:
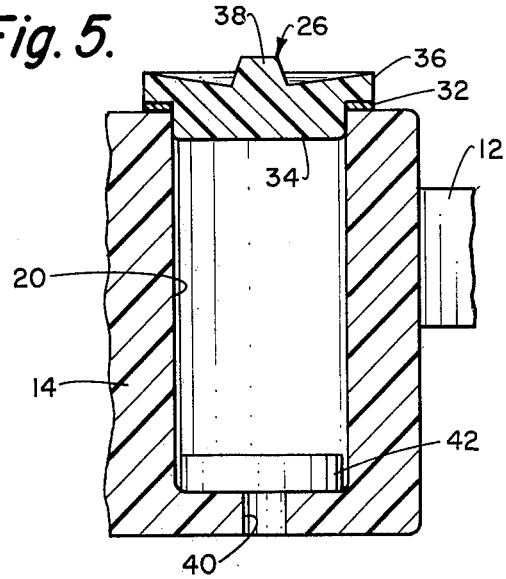
FIG. 5 is a cross-sectional view taken through one of the pockets taken along line 5—5 of FIG. 1.
Figure 6:
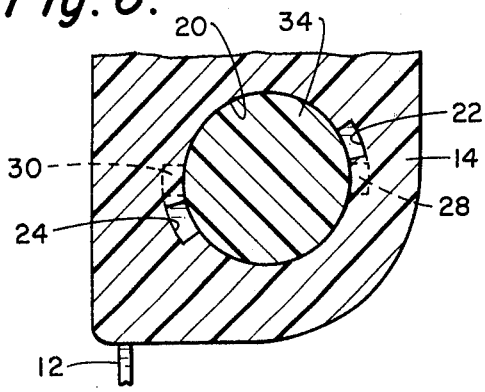
FIG. 6 is a cross-sectional view through the lid of the beverage belt of this invention taken along line 6—6 of FIG. 4.

Referring specifically to the drawing, there is shown in FIG. 1 the beverage belt 10 of this invention which is composed basically of a belt 12 and a beverage container supporting housing 14. The free ends 16 and 18 of the belt are to be secured together with some type of securing means. A preferable form of securing means will be a tightly packed hook and eye arrangement which is frequently sold under the trade name of Velcro.

The belt 12 can be constructed of any flexible material, such as leather, plastic, or the like. The housing 14 is to be constructed of an insulative material, such as a polyethalene type of plastic. However, it is considered to be within the scope of this invention that other types of plastics could be employed.

Formed within the housing 14 are a plurality of beverage containing pockets 20. It is to be noted that only three such pockets 20 are shown, but the housing 14 may contain more or less in number of pockets 20.

Each pocket 20 is formed in a basically cylindrical shape and is adapted to closely interfit with a conventional size cylindrical beverage container, such as a beverage can. However, it is considered to be within the scope of this invention that the pockets 20 could be formed in other shapes, other than that shown in order to fit with a particular size of other type of beverage container.

The belt 12 extends through a portion of the housing 14 and in actual practice the belt 12 will be fixedly secured to the housing 14.

Located within the side wall of each of the pockets 20 is a pair of diametrically located bayonet slots 22 and 24. A lid 26 is employed for each pocket 20. Each lid includes, on opposite sides thereof, a pair of protuberances 28 and 30. Protuberance 28 is adapted to connect with one of the bayonet slots, such as bayonet slot 22 and protuberance 30 is adapted to connect with the other bayonet slot, such as bayonet slot 24. When the lid 26 is fully inserted into the lower end of the bayonet slot, the lid is then rotated a small amount which then locks each lid 26 to the housing 14.

A compressible disc 32 is located about a smaller diametered section 34 of the lid 26. This smaller diametered section 34 is a section which supports the protuberances 28 and 30. Disc 32 rests against a larger diametered section 36 of the lid 26. When the lid 26 is connected with a pocket, the disc 32 will rest against the area of the housing 14 located directly about the pocket. When the lid 26 is fully inserted within its bayonet slots, the disc 32 is slightly compressed forming an air-tight seal between the lid 26 and the housing 14.

The exterior surface of the enlarged portion 36 includes a protruding member 38 which is adapted to be grasped in order to effect insertion and removal of the lid. The area on either side of the protruding member 38 is recessed in order to facilitate grasping of the protruding member 38.

Located within the housing 14 in the area of the bottom of each of the pockets 20 is an aperture 40. The aperture 40 is provided so that a tubular object can be inserted therein in order to push the beverage container that may be contained within the pocket 20 in an upward direction in order to facilitate removal of the beverage container from the pocket 20. It is to be understood that this procedure would be effected only when the lid 26 has been removed from the respective pocket.

It may be desirable to close off the aperture 40 during use from the ambient. This is to be done so as to keep the beverage container in a cold state for as long as possible. A plastic disc 42 may be placed within each pocket 20 and rest against the bottom of the pocket and thereby close off the opening 40. However, when it is desired to remove the beverage container from the pocket 20, the operator still only needs to insert a tubular object through the opening 40 which will then contact disc 42 and the disc 42 along with the beverage container will be pushed in an upward direction in order to facilitate removal of the container from the pocket.

Figure 7:
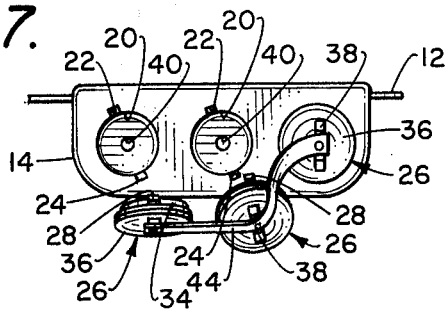
FIG. 7 is a plan view of a modified form of beverage belt construction of this invention.

A further modification may be to provide means to interconnect each of the lids 26. Once a lid 26 is removed from the housing 14, such may become disassociated from the beverage belt and actually may be lost. In normal practice, only one lid 26 will be removed at a time. A strap 44 may be secured to the protruding member 38 of each lid 26 thereby connecting together each of the lids 26 of the beverage belt. This will insure that the removed lid will be held in close proximity to the beverage belt and is not capable of becoming disassociated therefrom. The use of the strap 44 is shown in FIG. 7 of the drawing.

The strap 44 may be attached to the protruding members 38 by means of conventional snaps or in any other manner in order to fixedly secure the strap 44 to each lid 26.

What is claimed is:

1. A beverage belt comprising:

a belt havng a pair of free ends, securing means connected to said belt at said free ends to secure together the ends of said belt into an integral unit;

a housing having a plurality of beverage retaining pockets, said housing being attached to said belt, said pockets being spaced from each other, each said pocket being adapted to contain a beverage container;

a lid assembly including a separate lid for each of said pockets, each said lid to connect by connecting means with said housing to close its respective said pocket to the ambient;

said housing being constructed of a plastic insulative material, each said lid being constructed of a plastic insulative material;

located within said housing and communicating with each said pocket is an aperture, there being a separate said aperture for each said pocket, each said aperture located within the bottom of each said pocket;

means located within each said pocket for closing each said aperture to the ambient; and whereby an elongated object is insertable through said aperture to move a beverage container located within the said pocket upwardly and out of its respective said pocket.

2. A beverage belt comprising:

a belt having a pair of free ends, securing means connected to said belt at said free ends to secure together the ends of said belt into an integral unit;

a housing having a plurality of beverage retaining pockets, said housing being attached to said belt, said pockets being spaced from each other, each said pocket being adapted to contain a beverage container;

a lid assembly including a separate lid for each of said pockets, each said lid to connect by connecting means with said housing to close its respective said pocket to the ambient;

said housing being constructed of a plastic insulative material, each said lid being constructed of a plastic insulative material;

located within said housing and communicating with each said pocket is an aperture, there being a separate said aperture for each said pocket, each said aperture located within the bottom of each said pocket;

a spacing disc located adjacent the bottom of each said pocket to normally close its respective said aperture to the ambient; and whereby an elongated object is insertable through said aperture to move a beverage container located within the said pocket upwardly and out of its respective said pocket.

3. The beverage belt as defined in claim 1 wherein:

said connecting means comprising a bayonet slot arrangement formed within the side wall of each said pocket, each said lid having protuberance means connectable with said bayonet slot assembly.

4. The beverage belt as defined in claim 3 wherein:

each said lid including a compressible ring located upon the underside of said lid, said compressible ring adapted to contact the portion of the housing directly surrounding said pocket, whereby said ring is compressed with said lid in tight engagement with said housing to thereby form an air-tight connection between said lid and said housing.

* * * * *